United States Patent [19]

Ferderber

[11] Patent Number: 4,576,279

[45] Date of Patent: Mar. 18, 1986

[54] DRAWING SUPPORT AND STORAGE APPARATUS

[76] Inventor: Fred F. Ferderber, 4863 Redwillow Ave., Orlando, Fla. 32808

[21] Appl. No.: 674,780

[22] Filed: Nov. 26, 1984

[51] Int. Cl.[4] ..... A45C 11/24; B65D 85/67

[52] U.S. Cl. ..... 206/225; 206/226; 206/409

[58] Field of Search ..... 206/225, 226, 409

[56] References Cited

U.S. PATENT DOCUMENTS

| | | | |
|---|---|---|---|
| 948,506 | 2/1910 | Horton | 206/409 |
| 1,097,385 | 5/1914 | Barns | 206/409 |
| 1,523,297 | 1/1925 | Savery | 206/226 |
| 3,884,351 | 5/1975 | James | 206/225 |

*Primary Examiner*—William Price
*Assistant Examiner*—Brenda J. Ehrhardt
*Attorney, Agent, or Firm*—William M. Hobby, III

[57] ABSTRACT

An apparatus for supporting and storing drawings, such as blueprints, includes an elongated outer casing having an elongated opening therein. A pair of end caps are attached to each end of the casing with each end cap having a hub formed therein to hold a central shaft inside the elongated outer casing. A flexible support surface is attached to the central shaft and is rollably mounted in the casing and protrudes through the elongated opening in the casing for removably supporting a drawing thereon. A flexible, transparent cover may be supported over the flexible support surface for holding drawings or blueprints therebetween. A gripping handle is attached to one end of the flexible support surface exterior of the casing for pulling the drawings out of the casing. One end cap is attached to the elongated shaft while the shaft is rotatably supported in the other end cap to allow the drawings and support surface to be rolled back into the casing by rotating the one end cap.

2 Claims, 6 Drawing Figures

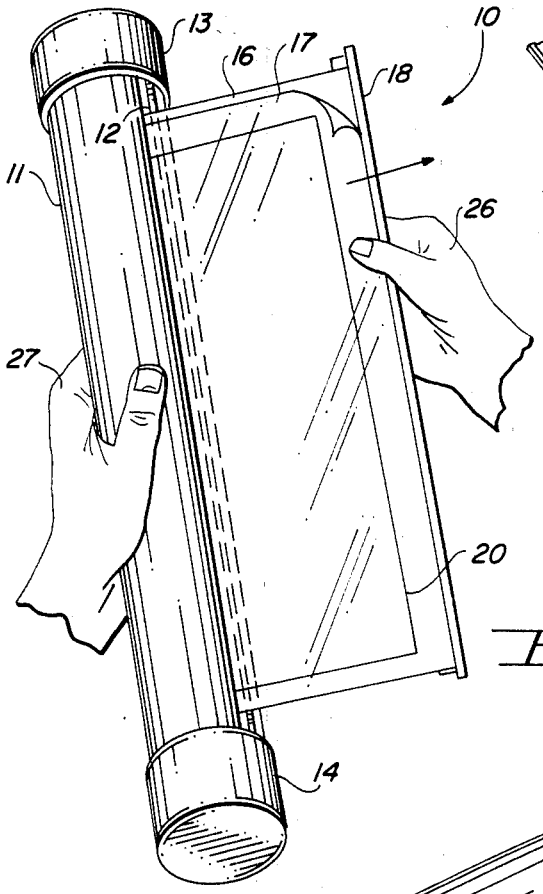
FIG. 1
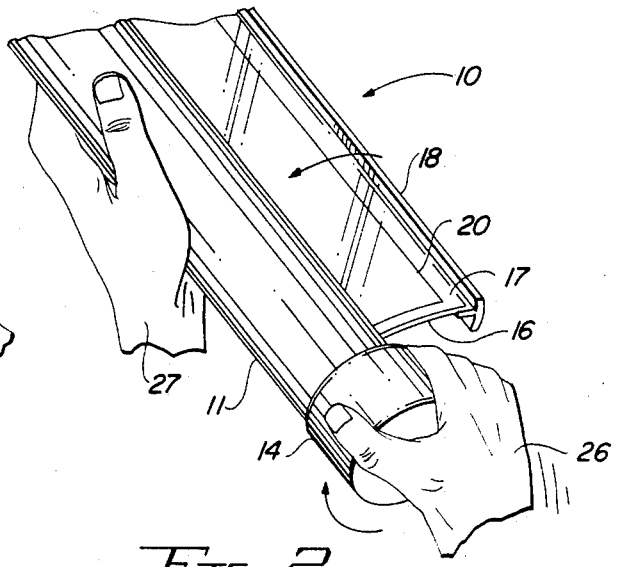
FIG. 2
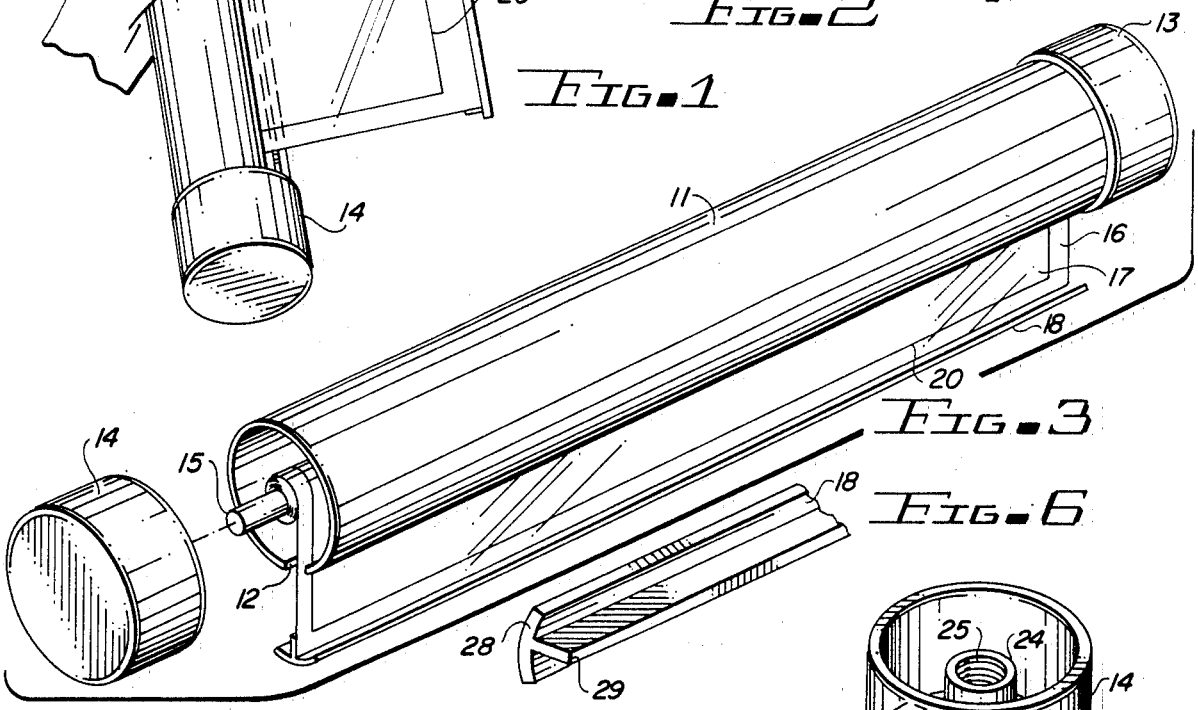
FIG. 3
FIG. 6
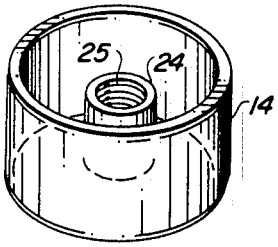
FIG. 5
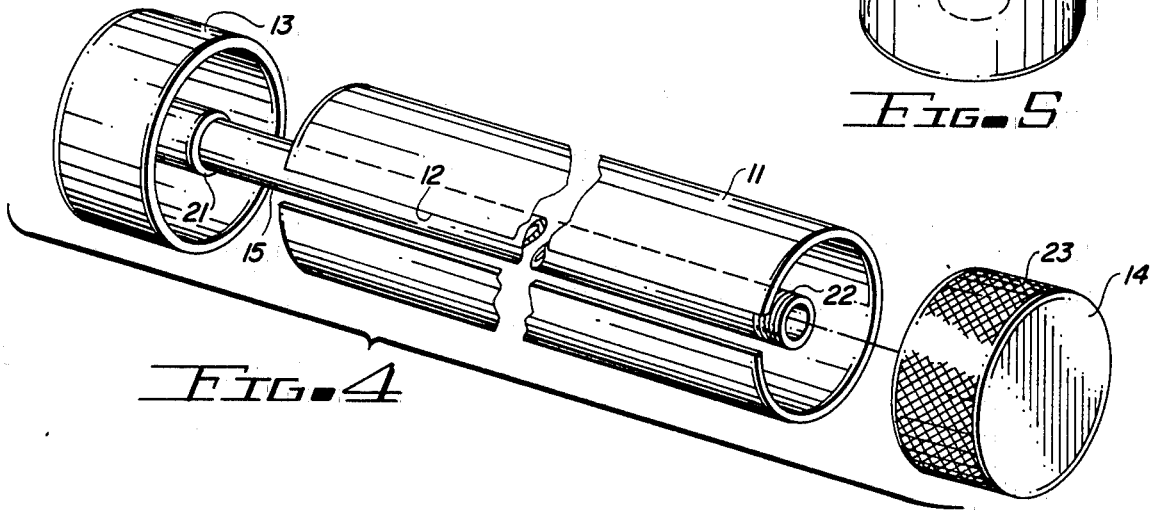
FIG. 4

DRAWING SUPPORT AND STORAGE APPARATUS

BACKGROUND OF THE INVENTION

The present invention relates to an apparatus for supporting and storing of drawings and especially for the supporting and storing of blueprints, and the like, for ready use in the field.

Blueprints and other drawings have been commonly stored in a variety of manners, including in rolls placed in pigeonholes, in special supports, stacked in a corner and folded in files. Drawings are also stored in special cabinets for the storage of drawings, having slide-out drawers for storing the drawings flat rather than in rolls. In has also been suggested to store the drawings with hangers in a hanging position. Drawings are frequently stored and shipped in carboard tubes, which allows the drawings to be protected, and removed from the tube when needed.

The present invention is directed towards a storage tube for drawings, which tube can be easily carried in the field and used on-site or in a shop as well as stored in an office. The drawings can be quickly pulled from the tube and viewed under a protective transparent cover while being supported against a support surface and then rolled back into the tube for storage.

Prior U.S. patents which store items in a rolled-up fashion include the Whilden U.S. Pat. No. 438,770, for a stamp package including a tube having stamps supported on a pull-out strip of parafin paper. The Cornell U.S. Pat. No. 4,345,392, shows a calendar support and a tube for being pulled therefrom and having an internal roller on each end thereof so that each month can be viewed and then torn off.

The Gunn U.S. Pat. No. 4,192,561, shows a storage container for rolled tissue paper having a center shaft, end caps and an outer roller, while the Horn U.S. Pat. 3,737,360, show an outer roller having an opening for drawing out adhesive. The Holtje U.S. Pat. No. 2,629,043, shows an illuminated message case in which message material is rolled out of a roll onto a surface and includes a strip and a wax-coated strip. The Idoine, U.S. Pat. No. 2,787,070, shows a map holder in which a map is unrolled for viewing portions thereof.

The present invention advantageously provides a storage for drawings and blueprints, both inside and outside, while protecting the prints from the elements and from wear by continuous usage and allows rapid access to the drawings as needed.

SUMMARY OF THE INVENTION

A drawing support and storage apparatus is provided with an elongated outer casing having an elongated opening therein. A pair of end caps are removably attached to each end of the casing. Each end cap has a center hub for supporting a center shaft through the casing. One end of the shaft is rotably supported in the hub, while the other end is threadably supported thereon for rotating the shaft in the casing. A flexible planar support surface has one end thereof attached to the shaft and is rotably mounted around the shaft in the casing with one edge protruding through the elongated opening in the casing. The other end of the flexible planar surface has a handgrip attached thereto on the outside of the casing for pulling the flexible planar surface into and out of the cylindrical casing. A flexible, transparent cover is mounted on top of the flexible planar surface for protecting drawings therebetween so that the flexibel planar surface, transparent cover and drawings can be stored in a roll in the outer casing and drawn out of the casing by gripping the handle and pulling the flexible planar surface. The casing may also have a handle thereon.

BRIEF DESCRIPTION OF THE DRAWINGS

Other objects, features and advantages of the present invention will be apparent from the written description and the drawings in which:

FIG. 1 shows a perspective view of a support and storage apparatus in accordance with the present invention, with the drawings being pulled from the casing;

FIG. 2 shows a perspective view of the apparatus in accordance with claim 1 with the drawings being returned to the casing;

FIG. 3 shows a perspective view of the apparatus for holding drawings in accordance with FIGS. 1 and 2 with one end cap removed;

FIG. 4 shows an exploded view of the casing end caps and center shaft in accordance with FIGS. 1 through 3;

FIG. 5 shows a perspective view of a threaded end cap; and

FIG. 6 shows a perspective view of the gripping handle.

DESCRIPTION OF THE PREFERRED EMBODIMENT

Referring to FIGS. 1 through 6 of the drawings, a drawing and blueprint storage and support apparatus 10 is illustrated having a cylindrical outer casing 11 having an elongated opening or slot 12 therein and an end cap 13 on one end and an end cap 14 on the other end of the casing 11. A center shaft or tube 15 is mounted between the end caps 13 and 14 in the casing 11 and has a flexible planar support surface 16 attached thereto. The flexible planar surface 16 has one end attached to the center shaft 15 by tape, adhesive or with a special attachment in which one edge of the surface 16 is stuck in a reel end opening. A transparent outer surface 17 may also be attached to the center reel 15 for riding on top of the support surface 16. The planar surface 16 has a gripping handle 18 which is an elongated handle made of aluminum or the like, and has the planar surface 16 attached thereto. Gripping handle 18 remains outside the casing 11 and is too large to pass through the opening 12 and is used for grabbing and pulling the planar surface out of the cylindrical casing 11.

Blueprints or drawings 20 may be placed between the planar support surface 16 and the transparent cover 17 for being supported therein, while in the casing 11 the flexible planar surface 16, drawings 20 and transparent cover 17 are rolled as shown in FIG. 3 around the shaft 15. The shaft 15 is supported in a central hub 21 in the end cap 13 and is rotably supported therein, with the hub 21 having a smooth surface for acting as a bushing for one end of the shaft. In addition the shaft 15 has a smooth surface on one end and has a threaded end portion 22 on the other end thereof and may have an elongated slot 23 for supporting one edge of the support surface 16 therein. The cap 14 may have a knurled gripping surface 23 therearound and may be of a cylindrical shape for press-fitting over the outside of the casing 12. Similarly, the end cap 13 fits around the other end of the cylindrical casing 12. End cap 14 has a center hub 24 having internal threads 25 for engaging the external threads 22 on the shaft 15. Threading the end piece 14 on the shaft 15 allows the end piece 14 to be turned as shown in FIG. 2 with one hand to roll the drawing 20, planar surface 16 and cover 17 back into the casing 11.

In operation, the stored drawings 20 may be pulled from the casing as shown in FIG. 1 by the hand 26 grabbing the handle 18 and the hand 27 grabbing the cylindrical casing 11 and pulling the two apart to extend the drawings 20. The drawings may be removed from between the support surface 16 and the transparent cover 17 for writing upon or may be left behind the transparent cover while being viewed. Once the drawings are no longer needed, the hand 17 can continue its grip on the tube 11 while the hand 26 can rotate the end 14 as shown in FIG. 2 to roll the drawings 20, planar surface 16 and transparent cover 17 back into the tube for storage or for transportation to a building or machine shop site. The tube as shown, advantageously, provides tube storage of drawings which may be readily accessed and may be easily carried to the field without having the drawings becoming damaged or worn. However, it should be clear that the present invention is not to be considered as being limited to the form shown, which is to be considered illustrative rather than restrictive.

I claim:

1. A drawing support and storage apparatus comprising in combination:

an elongated outer casing having an elongated opening therein;

a pair of end caps, at least one end cap being removably mounted to said elongated outer casing;

a flexible planar surface rotably mounted in said casing and protruding through said elongated opening for removably supporting a drawing thereon is said casing, said flexible planar surface having one edge attached to an elongated shaft in said elongated outer casing;

said elongated shaft comprising a center-shaft connected between said end caps in said elongated outer casing, said center shaft including a hollow center tube having a slot therein for attaching the end of said flexible planar surface thereinto and said center shaft having one smooth end for rotably attachng to one said end cap and the other end of said center shaft being threadably connected to a threaded hub on the other said end cap;

a flexible, transparent cover attached to said center shaft over said flexible planar surface for supporting a drawing, or the like, between said flexible planar surface and said flexible transparent cover; and grip means attached to said flexible planar surface exterior of said casing for gripping and removing a portion of said planar surface and flexible, transparent cover from said casing, said grip means having an elongated handle having a generally T-shaped cross section.

2. A drawing support and storage apparatus in accordance with claim 1 in which said elongated outer casing is a cylindrical casing having an elongated slot extending axially the length of said casing.

* * * * *